US009150225B2

(12) United States Patent
Somensi

(10) Patent No.: US 9,150,225 B2
(45) Date of Patent: Oct. 6, 2015

(54) SAFETY DEVICE FOR RAILWAY VEHICLES

(71) Applicant: VALE S.A., Rio de Janeiro (BR)

(72) Inventor: Caue Stocchi Somensi, Vitoria (BR)

(73) Assignee: VALE S.A., Rio de Janeiro (BR)

( * ) Notice: Subject to any disclaimer, the term of this patent is extended or adjusted under 35 U.S.C. 154(b) by 0 days.

(21) Appl. No.: 13/936,855

(22) Filed: Jul. 8, 2013

(65) Prior Publication Data

US 2014/0007790 A1 Jan. 9, 2014

Related U.S. Application Data

(60) Provisional application No. 61/668,745, filed on Jul. 6, 2012.

(51) Int. Cl.
*B61D 15/06* (2006.01)
*B61F 19/06* (2006.01)

(52) U.S. Cl.
CPC ..... *B61D 15/06* (2013.01); *B61F 19/06* (2013.01)

(58) Field of Classification Search
CPC ..... B61D 15/06; B61D 17/02; B61D 17/06; B60R 19/00; B60R 19/06; B60R 19/18; B60R 19/20; B60R 19/205; B60R 21/34; B60R 21/36; B60R 21/276; B61F 19/00; B61F 19/06
USPC ..... 105/392.5, 393, 394; 213/220–223
See application file for complete search history.

(56) References Cited

U.S. PATENT DOCUMENTS

| | | | | |
|---|---|---|---|---|
| 6,039,349 | A * | 3/2000 | Laporte et al. | 280/748 |
| 6,454,326 | B2 * | 9/2002 | Demarquilly et al. | 293/107 |
| 6,474,489 | B2 * | 11/2002 | Payne et al. | 213/221 |
| 6,497,183 | B2 * | 12/2002 | Demarquilly et al. | 105/392.5 |
| 6,619,491 | B2 * | 9/2003 | Payne et al. | 213/221 |
| 6,814,246 | B2 * | 11/2004 | Payne et al. | 213/221 |
| 8,622,003 | B2 * | 1/2014 | Radewagen | 105/238.1 |
| 2001/0007316 | A1 * | 7/2001 | Payne et al. | 213/220 |
| 2002/0005142 | A1 * | 1/2002 | Demarquilly et al. | 105/392.5 |
| 2003/0024894 | A1 * | 2/2003 | Payne et al. | 213/220 |
| 2014/0007790 | A1 * | 1/2014 | Somensi | 105/392.5 |

* cited by examiner

*Primary Examiner* — Jason C Smith
(74) *Attorney, Agent, or Firm* — Arent Fox LLP

(57) ABSTRACT

A safety device for railway vehicles is provided, more specifically a safety device that reduces the negative consequences resulting from collisions or pedestrian accidents involving railway vehicles. As such, the railway vehicle safety device consists of a main impact dampening area and at least one secondary support and resistance area, with the safety device being installed on the railway vehicle's front end, so that the main impact dampening area dampens the force of the impact caused by a collision between the vehicle and a pedestrian.

17 Claims, 7 Drawing Sheets

SAFETY DEVICE FOR RAILWAY VEHICLES

CROSS-REFERENCE TO RELATED APPLICATIONS

This application claims priority to U.S. Provisional Patent Application No. 61/668,745, filed Jul. 6, 2012. The disclosure of the prior application is hereby incorporated in its entirety by reference.

THE FIELD OF THE INVENTION

The present invention refers to a safety device for railway vehicles, more specifically to a safety device that reduces the negative consequences resulting from collisions or pedestrian accidents involving railway vehicles.

BACKGROUND

The accidents involving railway vehicles (i.e. locomotives, wagons) often have serious consequences, since material damage to the equipment until serious injury or death of those involved.

Generally, the efforts to prevent railway accidents have been focused on their prevention: collision sensors, alarms, planning escape routes, and other types of preventive methods or devices. If the prevention of this kind of accident fails the results are disastrous.

Considering the most common railway accidents, running over is particularly worrisome and dangerous. The dimensions and weight of the railroad car cause a fatality as a consequence of this type of impact. Other equally tragic, yet common injuries include serious injuries such as mutilation or generalized fractures.

Even if impact is only partial, the shock of collision between railroad cars and people results in consequences as disastrous as those mentioned above.

OBJECTIVES OF THE INVENTION

One of the objectives of this present invention, therefore, is to provide a safety device capable of reducing the negative consequences resulting from collision or running over involving railway vehicles.

Another objective of this present invention is to provide a safety device capable of reducing the impact from the collision between a railroad car and a pedestrian.

BRIEF SUMMARY OF THE INVENTION

This present invention meets the aforementioned objectives by means of a safety device for railway vehicles consisting of a main impact dampening area and at least one secondary support and resistance area. The safety device is installed on front of the railroad car so that the main impact dampening area dampens the force generated by the collision between the vehicle and a pedestrian.

In the preferred embodiment of the invention, the main impact dampening area and the secondary support and resistance area consist of inflatable bags, in which the main impact dampening area's internal pressure is less than that of the secondary support and resistance area. The safety device can work with pressures that vary between 1 Pa-1 MPa.

Still in a preferred embodiment, the device further comprises a tilting mechanism that tilts the device's body laterally in relation to the direction in which the vehicle is moving.

In one embodiment of the invention, the device comprises two secondary support and resistance areas, with the first one consisting of an inflatable bag extending in a plane parallel to the front of the vehicle and the second one consisting of a portion of an inflatable bag sticking out from the lower end of the first secondary area.

In another embodiment, the safety device comprises three secondary resistance and support areas, with the first one consisting of an inflatable bag extending in a plane parallel to the vehicle's front end, and the second and third areas consisting of inflatable side bags sticking out the first secondary area. In this embodiment, the inflatable side bags preferably extend at an inclined angle in relation to a plane that runs parallel to the rails. The device further consists of a support area formed by an inflatable bag that sticks out from the lower end of the first secondary area. The device may further comprise a mesh or elastic net that joins the three secondary areas together.

In the invention's preferred embodiment, the device further consists of a casing installed on the vehicle's front end that is capable of stowing the impact dampening and support and resistance areas when the device is not activated.

In another embodiment of the present invention, the main impact dampening area consists of a mesh or elastic net. The device further comprises two supporting and resistance areas made up of inflatable side bags. In this embodiment, the safety device may further comprise an upper mesh or elastic net that joins the inflatable side bags, and a direction area formed by a crossbar connected to the side bags. Preferably, the inflatable bags are made of polymeric materials, natural or synthetic.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
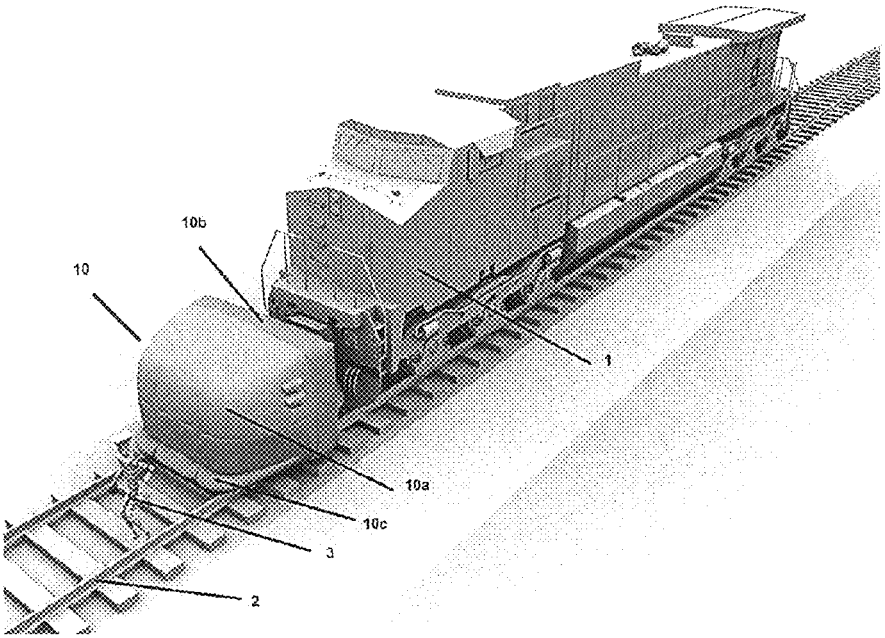
FIG. 1 shows a schematic view of a railroad car fitted with the safety device according to the first preferable embodiment of the present invention, with the device shown after being actuated.

The present invention shall be further detailed based on the execution example depicted in the drawings.

FIGS. 1-5 show a preferred embodiment of the safety device.

FIG. 1 shows a railroad car (locomotive) 1 moving along the tracks 2. A pedestrian 3 is shown on the tracks at risk of being struck, and the safety device 10 is shown after being actuated/inflated.

As shown in the figures, the safety device is intended to be installed on the vehicle's front end 1.

In the preferred embodiment, the device 10 consists of an inflatable body with a main impact dampening area 10*a* and two secondary resistance and support areas 10*b* and 10*c*.

Figure 2:
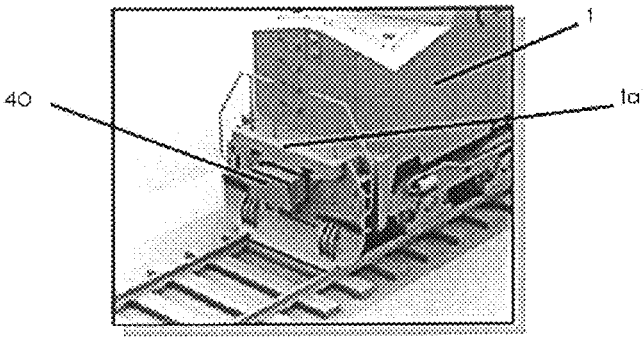
FIG. 2 shows a schematic view of the front of a railroad car fitted with the safety device according to the first preferable embodiment of the present invention, with the device shown while not actuated.

The main impact dampening area 10*a* consists of an inflatable bag whose pressure is less than that of the secondary resistance and support areas 10*b* and 10*c*. Therefore, impact dampening area 10*a* is suitable for dampening the impact with pedestrian 3 at the time of collision, whereas areas 10*b* and 10*c* provide the needed resistance to the device 10 and stability to absorb the impact. FIG. 2 shows the deactivated device 10. As can be seen, the device 10 is preferably installed on the locomotive's head piece, centrally attached below the base of the catwalk. This position is chosen as it does not interfere with the operation or use of locomotive's equipment or the vehicle's coupling connections.

It should be emphasized, however, that the safety device could be installed on any other suitable position provided it allows the device to be activated and inflated in time to absorb the impending impact.

The connection between the components of the safety device is performed through pipes, hoses, valves and nozzles that are part of a filling system (not shown) which allows inflating the said bags with fluids such as oxygen, nitrogen, carbon dioxide, helium, ozone or compressed air originated from a electrochemical and/or chemical reaction. The gases may be transformed by compression, vaporization and sublimation effects. The velocity of gas flow within the device can vary between 1 L/m-200 $m^3$/s.

In this present invention's preferred embodiment, for the safety device to be installed, the inflatable body is wrapped into an enclosure 40 in a box-like format (see FIG. 2), which opens when actuated, thereby allowing the body to burst out when inflated. The said enclosure 40 may be done by metallic or polymeric material.

The activation of the safety device may be performed by a manual or automatic system. The device is inflated in two stages: first by means of a chemical reaction and then by compressed air from a cylinder. The inflation process should take no more than 5 seconds.

Figure 3:
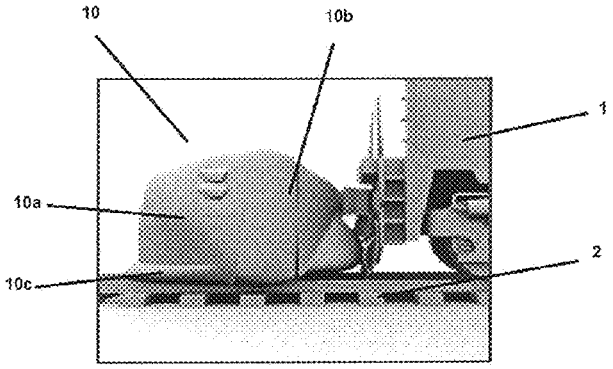
FIG. 3 shows a side view of a railroad car fitted with the safety device according to the first preferable embodiment of the present invention, with the device shown after being actuated.
Figure 4:
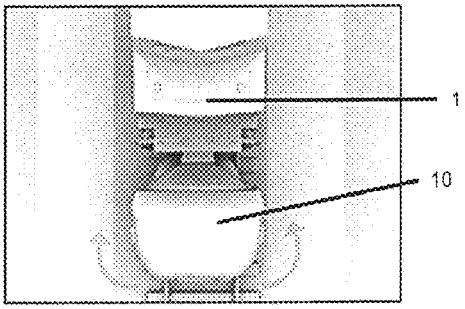
FIG. 4 shows a top view of a railroad car fitted with the safety device according to the first preferable embodiment of the present invention, with the device shown after being actuated.

FIGS. 3 and 4 respectively show a side view and top view of the device 10 installed on the railroad car 1 (with only its front being shown).

As better shown in FIG. 4, which is the preferred embodiment of the invention, the device 10 further includes a tilting mechanism that enables it to tilt in the direction of the arrows shown in the figure. The purpose of this mechanism is to direct the pedestrian off the tracks after the device 10 has dampened impact.

Figure 5A:
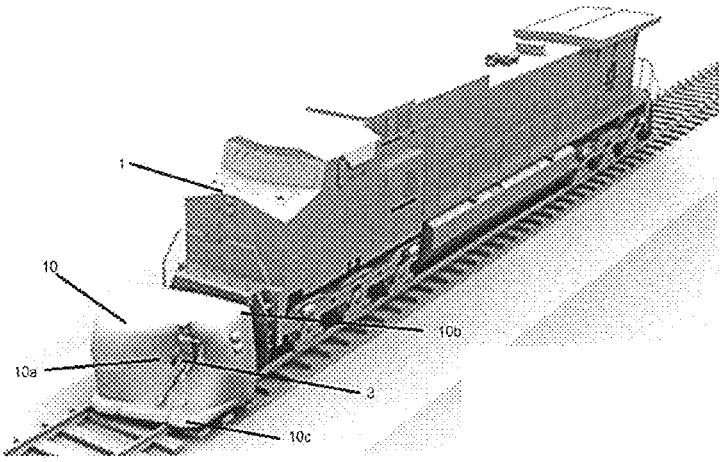
FIGS. 5*a* and 5*b* are schematic illustrations of the safety device in operation according to the first embodiment of the present invention during impact between the railroad car and a pedestrian.
Figure 5B:
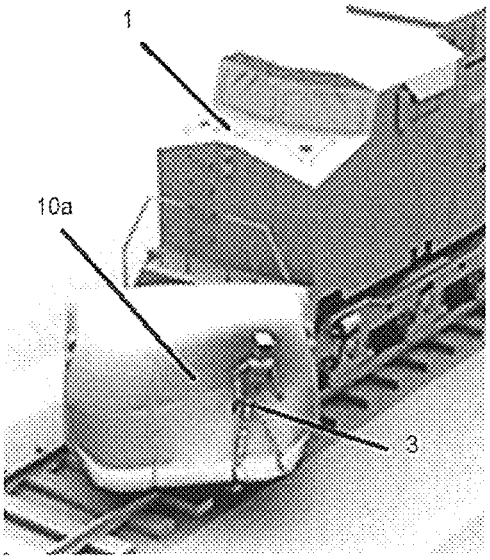

FIGS. 5*a* and 5*b* illustrate how the device 10 initially operates. These figures show a time immediately after impact between the vehicle and a pedestrian 3.

During impact, the pedestrian 3 is flung against the inflatable device's 10 impact dampening area 10*a*. As the pressure in this area is lower, the pedestrian's body 3 presses against the bag, the collision impact is dampened, and the pedestrian's body is supported by the dampening area 10*a*.

Next, the device 10 tilts to one side (see FIG. 5*b*) and remove the pedestrian 3 from the tracks. As the inflatable bag is resilient, when it returns to its normal condition, the pedestrian 3 is pushed out of the device 10, and off the tracks.

In this present invention's preferred embodiment, the device 10 is activated by the driver. Upon realizing the risk of colliding with a person, the driver presses a button that opens the casing and inflates the device.

Figure 6:
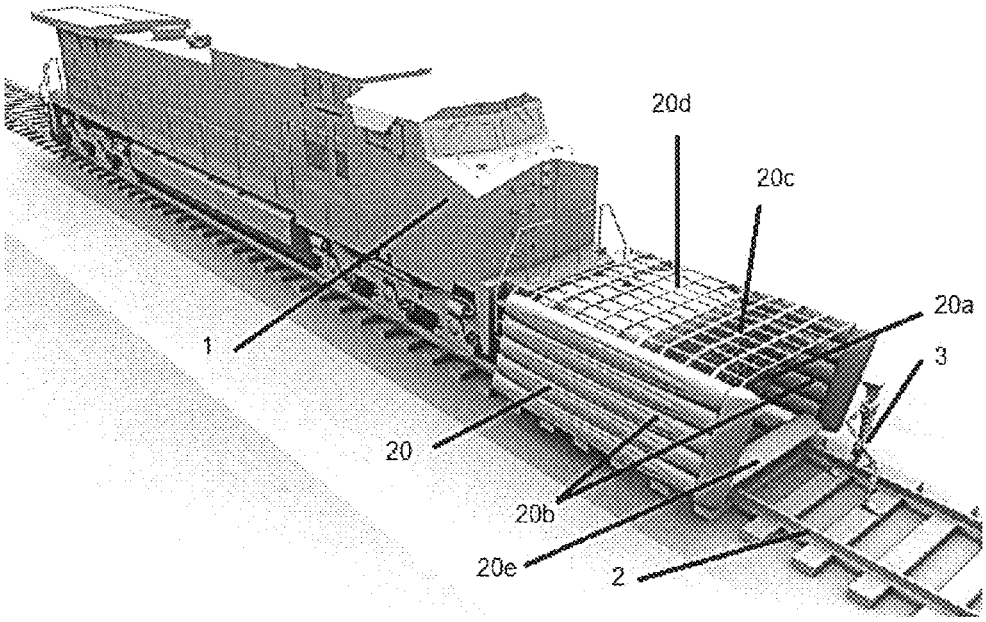
FIG. 6 shows a schematic view of a railroad car fitted with the safety device according to the second embodiment of the present invention, with the device shown after being actuated.
Figure 7:
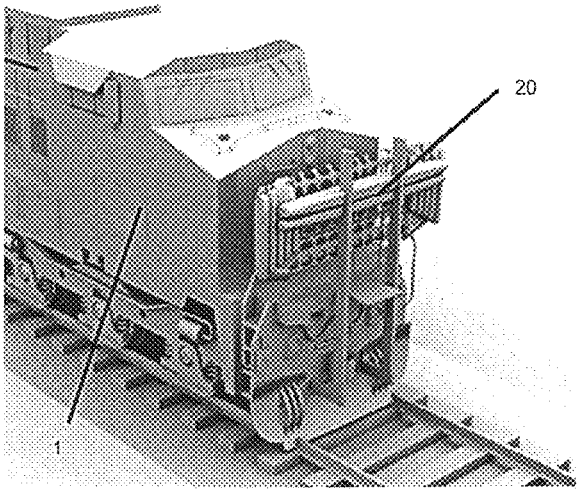
FIG. 7 shows a schematic view of the front a railroad car fitted with the safety device according to the second embodiment of the present invention, with the device shown as being deactivated.
Figure 8:
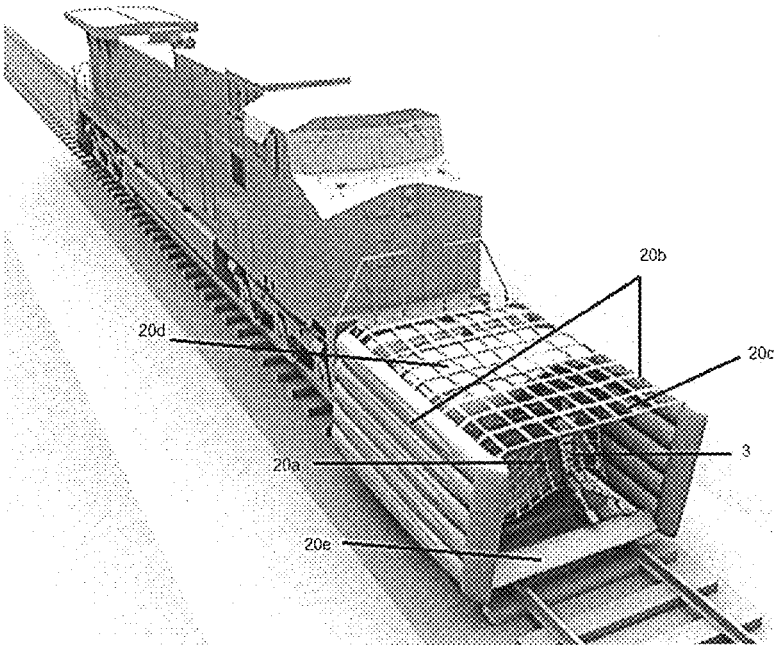
FIG. 8 is a schematic illustration of the safety device in operation according to the second embodiment of the present invention during impact between the railroad car and a pedestrian.
Figure 9:
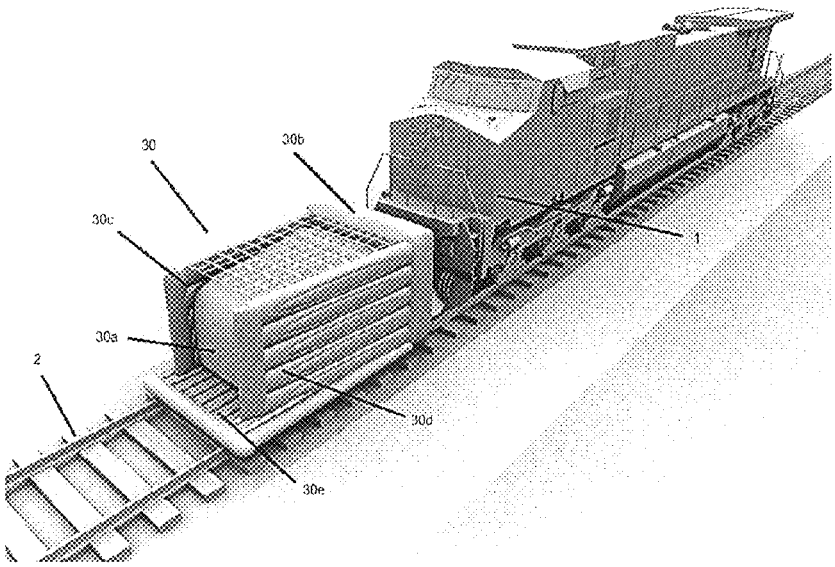
FIG. 9 shows a schematic view of a railroad car fitted with the safety device according to the third embodiment of the present invention, with the device shown after being actuated.
Figure 10:
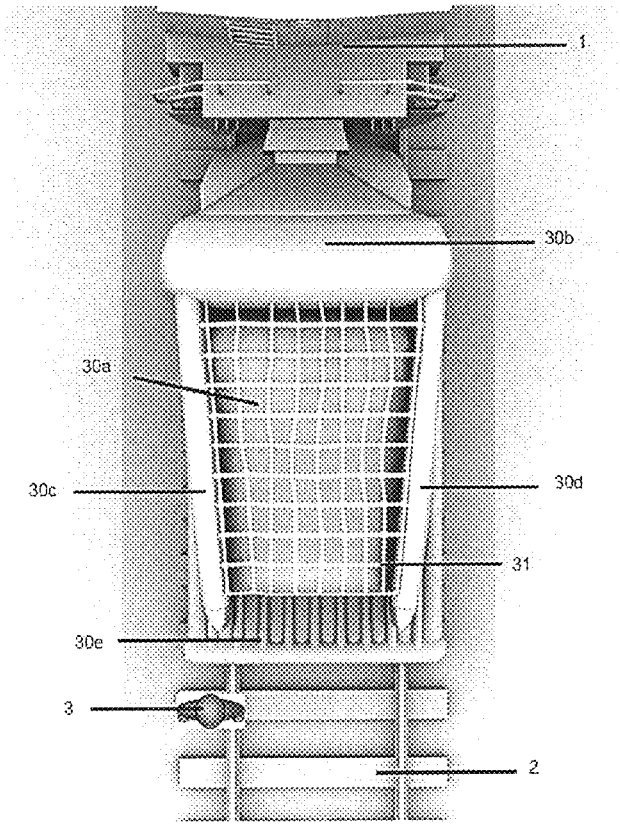
FIG. 10 shows a top view of a railroad car fitted with the safety device according to the third embodiment of the present invention, with the device shown after being actuated.
Figure 11:
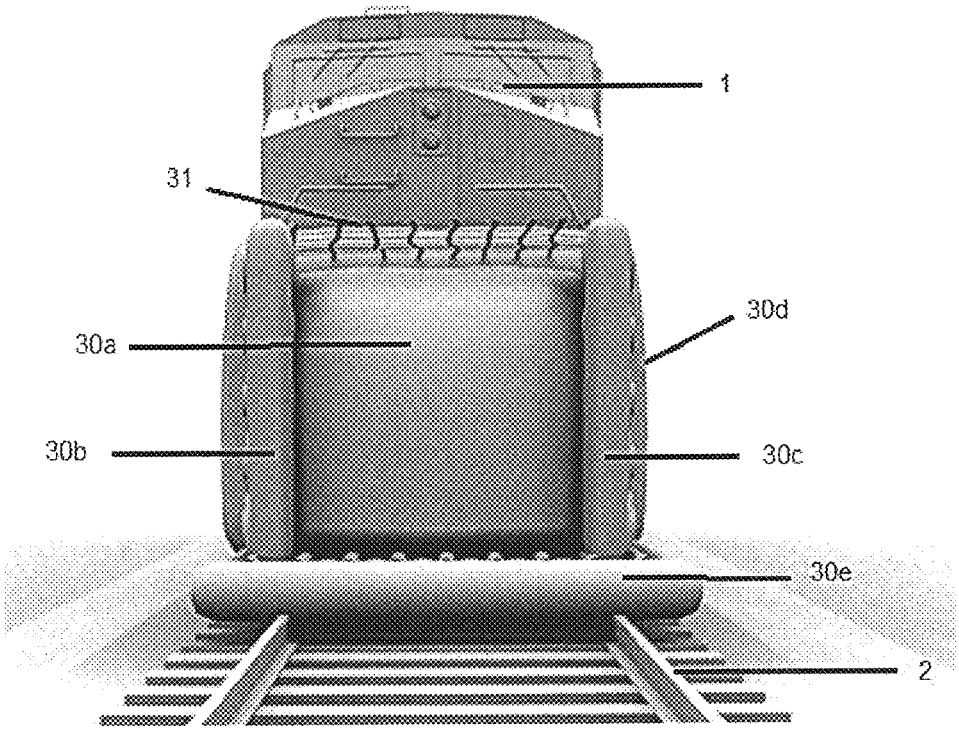
FIG. 11 shows a front view of a railroad car fitted with the safety device according to the third embodiment of the present invention, with the device shown after being actuated.

FIGS. 6 to 8 show an alternative embodiment of the present invention's device.

In this embodiment, the safety device 20 consists of an impact dampening area 20*a* made up of a mesh or elastic net and two support and resistance areas 20*b* made up of the inflatable side bags.

The safety device 20 may also include an upper mesh or elastic net 20*c* that joins the side bags 20*b*, a secondary inflatable bag 20*d*, and a direction area 20*e*.

The direction area 20*e* preferably consists of a crossbar 20*e* connected to the side bags. This bar 20*e* is positioned on the lower front of the device 20, so that, at the time of impact between the vehicle 2 and pedestrian 3, the bar 20*e* makes contact with the pedestrian's lower body 3.

After contact has been made between the bar 20*e* and pedestrian 3, the pedestrian's body 3 is flung against the impact dampening mesh 20*a* (see FIG. 8).

Unlike the preferred embodiment shown in FIGS. 1 through 5, in the second embodiment, the present invention's device is not activated only at the time of impact. As such, the device 20 remains activated while the vehicle is moving, unless intentionally deactivated.

FIG. 8 shows a deactivated device 20. As can be seen, when deactivated, the device 20 can be placed in a retracted position, with the inflatable bags not inflated.

FIGS. 9-12 show other alternative embodiment of the present invention's device.

In this embodiment, the safety device 30 consists of a main impact dampening area, three secondary resistance and support areas 30*b*, 30*c*, and 30*d*, and one support area 30*e*.

The main impact dampening area 30*a* consists of an inflatable bag whose pressure is less than that of the secondary areas 30*b*-30*d* and support area 30*e*.

The first secondary region 30*b* is an inflatable bag that, when inflated, is parallel to the vehicle's front end, and the second and third secondary regions 30*c* and 30*d* consist of inflatable side bags 30*c* and 30*d* that stick out from the first secondary region 30*b*.

The inflatable side bags 30*c* and 30*d* shall preferably be placed at an inclined angle in relation to a plane that runs parallel to the rails. This inclination, which may be about 6° toward the rails' center, causes close to a 90% reduction in the force of the impact with a pedestrian 3 walking along the rail's outer edge (see FIG. 10).

The device 30 may further include an upper mesh or elastic net 31 that joins the three secondary resistance and support areas 30*b*, 30*c*, and 30*d*.

Figure 12:
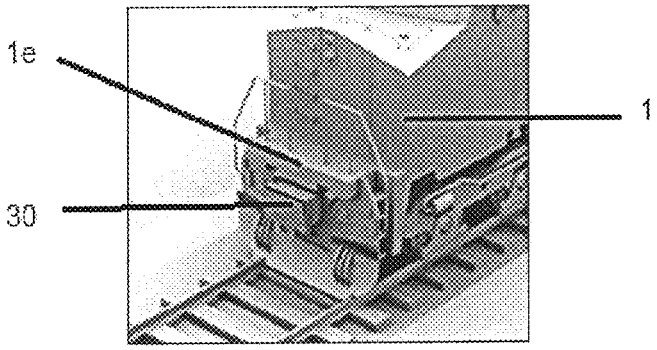
FIG. 12 shows a schematic view of the front of a railroad car fitted with the safety device according to the third embodiment of the present invention, with the device shown as being deactivated.

FIG. 12 shows the deactivated device 30. As can be seen, the device 30 is preferably installed on the locomotive's head piece, centrally attached below the base of the catwalk 1*e*. This position is chosen because it does not interfere with the locomotive's equipment or the vehicle's coupling connection.

Figure 13:
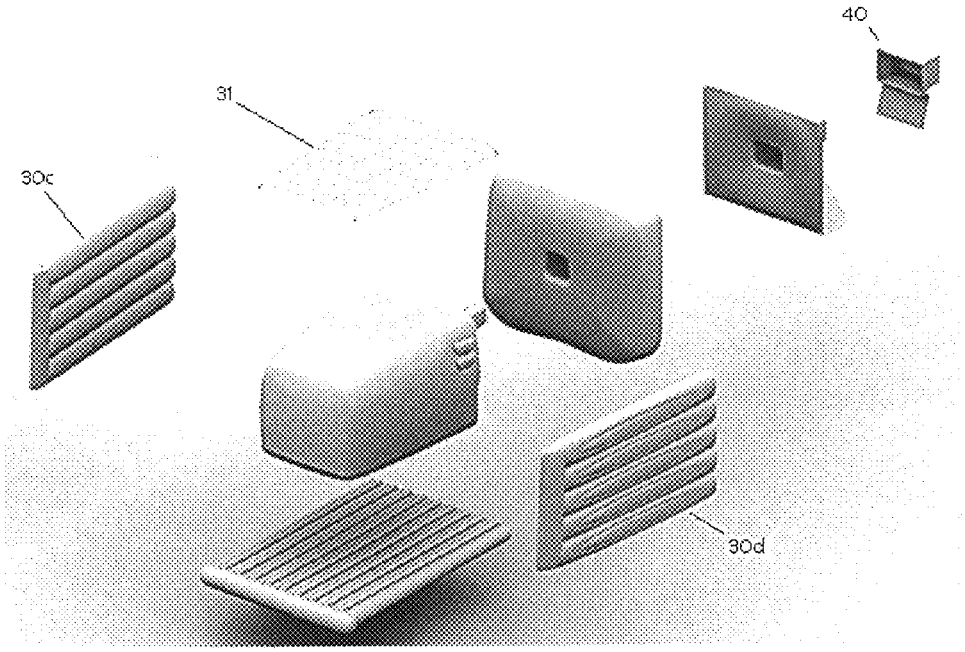
FIG. 13 shows an exploded view of the safety device.

In the FIG. 13, the separated portions of the safety device are illustrated in an exploded view.

It should be emphasized, however, that the safety device could be installed in any other suitable position, provided this position allows for driving and inflating the device in time to the proper absorption of the impending impact. The activation of the safety device may be performed by a manual or automatic system.

Further, the distance between the upper face of the rail head and the lower face of the safety device should be kept to a minimum. It may vary about 0 to 2 meters.

Obviously, those skilled in the art shall understand that the impact dampening area of the safety device may be comprised by many inflatable bags or may be integrally formed as part of a unitary, one-piece construction.

Finally, it should be understood that the figures show this invention safety system's preferred embodiment, with the actual scope of the invention being defined in the attached claims.

The invention claimed is:

1. A safety device for railway vehicles to reduce negative consequences resulting from collisions with objects or pedestrian accidents in railways, the safety device comprising:

a main impact dampening area; and at least two secondary support and resistance areas;

wherein the safety device is installed on a front of a railway vehicle in such a way that the main impact dampening area dampens a force of impact created by the railway vehicle when colliding with an object or pedestrian, and wherein the main impact dampening area and the secondary support and resistance areas include inflatable bags, and an internal pressure in the main impact dampening area is less than that of the secondary support and resistance areas, and wherein an inflatable bag of a first of the secondary support and resistance areas extends in a plane that runs parallel to the vehicle's front end and an inflatable bag of a second of the secondary support and resistance areas comprises a part that sticks out from the lower end of the first secondary support and resistance area.

2. The safety device according to claim 1, comprising a tilt mechanism that tilts the safety device's body laterally in relation to a direction in which the railway vehicle is traveling.

3. The safety device according to claim 1, wherein the inflatable bag of the second of the secondary support and resistance areas protrudes from the main impact dampening area.

4. The safety device according to claim 1, wherein inflatable side bags of a third and a fourth of the secondary support and resistance areas protrudes from the first secondary area.

5. The safety device according to claim 4, wherein the inflatable side bags extend at an inclined angle in relation to a plane that runs parallel to rails of the railway.

6. The safety device according to claim 4, comprising a mesh or elastic net that joins at least three of the secondary resistance and support areas.

7. The safety device according to claim 1, comprising a casing installed on the front end of the railway vehicle, the casing configured to receive therein the main impact dampening area and the support and resistance areas when the safety device is not activated.

8. The safety device according to claim 1, wherein the main impact dampening area includes a mesh or elastic net and the at least two secondary support and resistance areas are comprised of inflatable side bags.

9. The safety device according to claim 8, comprising an upper mesh or an upper elastic net that joins the inflatable side bags.

10. The safety device according to claim 8, comprising a direction area comprising a crossbar connected to the side bags.

11. The safety device, according to claim 1, comprising a filling mechanism arranged to inflate the inflatable bags with a fluid selected from a group consisting of oxygen, nitrogen, carbon dioxide, helium, ozone and compressed air, wherein the fluid is from one or more of an electrochemical reaction and a chemical reaction; the fluid capable of transformation by compression, vaporization and sublimation effects and wherein the safety device is arranged for a velocity of fluid flow within the safety device to vary between 1 L/m-200 $m^3$/s.

12. A safety device for railway vehicles to reduce negative consequences resulting from collisions with objects or pedestrian accidents in a railway, the safety device comprising:

a main impact dampening area; and at least three secondary support and resistance areas;

wherein the safety device is installed on a front end of a railway vehicle in such a way that the main impact dampening area dampens a force of impact created by the railway vehicle when colliding with an object or pedestrian, and wherein the main impact dampening area and the secondary support and resistance areas include inflatable bags, and an internal pressure in the main impact dampening area is less than that of the secondary support and resistance areas, and wherein an inflatable bag of a first of the secondary support and resistance areas extends in a plane parallel to the vehicle's front end and inflatable side bags of a second and a third of the secondary support and resistance areas sticks out from the first secondary area.

13. The safety device according to claim 12, wherein the inflatable side bags extend at an inclined angle in relation to a plane that runs parallel to rails of the railway.

14. The safety device according to claim 12, comprising a support area that sticks out from a lower end of the first secondary support and resistance area, the support area comprising an inflatable bag.

15. The safety device according to claim 12, comprising a mesh or elastic net that joins the at least three secondary resistance and support areas.

16. A safety device for railway vehicles to reduce negative consequences resulting from collisions with objects or pedestrian accidents in a railway, the safety device comprising:

a main impact dampening area; and at least two secondary support and resistance areas;

wherein the safety device is installed on a front of a railway vehicle in such a way that the main impact dampening area dampens a force of impact created by the railway vehicle when colliding with an object or pedestrian, and wherein the main impact dampening area includes a mesh or elastic net and the support and resistance areas are comprised of inflatable side bags.

17. The safety device according to claim 16, comprising an upper mesh or upper elastic net that joins the inflatable side bags.

* * * * *